US005729950A

United States Patent [19]

Hardy

[11] Patent Number: 5,729,950

[45] Date of Patent: Mar. 24, 1998

[54] ALL-METAL REINFORCING BUILDING FRAME

[75] Inventor: Gary Hardy, Ventura, Calif.

[73] Assignee: Hardy Industries, Inc., Ventura, Calif.

[21] Appl. No.: 630,893

[22] Filed: Apr. 3, 1996

[51] Int. Cl.[6] ..... E04B 1/343

[52] U.S. Cl. ..... 52/693; 52/645; 52/641; 52/695; 52/696

[58] Field of Search ..... 52/693, 645, 641, 52/695, 696

[56] References Cited

U.S. PATENT DOCUMENTS

| | | | |
|---|---|---|---|
| 2,963,127 | 12/1960 | Monville | 52/693 |
| 3,425,165 | 2/1969 | Cleveland | 52/645 |
| 5,487,479 | 1/1996 | Pech et al. | 52/645 X |

*Primary Examiner*—Carl D. Friedman
*Assistant Examiner*—W. Glenn Edwards
*Attorney, Agent, or Firm*—Lyon & Lyon LLP

[57] ABSTRACT

The improved reinforcing brace frame is utilized in building walls and the like to increase their resistance to severe stress such as it encountered during earthquakes, tornados, hurricanes, cyclones and other high wind situations. The frame is all metal, preferably steel and includes a vertically spaced pair of horizontally extending frame members joined at their opposite ends to a spaced pair of vertically extending frame members. The frame also includes a diagonal member rigidly connected to opposite ends of the horizontally extending frame members. Preferably, each of the horizontal frame members and the diagonal member include a pair of telescoping members so that the brace frame can be expanded and contracted in width to fit into a desired wall space. In one embodiment, the vertically extending frame members also each include a pair of telescoping members to control the heighth of the brace frame. After the brace frame is telescoped to closely fit into the desired position in a wall, all members of the frame are rigidly secured together, as by welding. The frame can also include spaced vertical support members between the vertical frame members. Such support members have slots through which the diagonal member passes and through which the diagonal member is rigidly joined to the support members. When the diagonal member telescopes, the slots are elongated to accommodate the changing angle of the diagonal member. Shims and other connectors are also provided.

3 Claims, 4 Drawing Sheets

ALL-METAL REINFORCING BUILDING FRAME

BACKGROUND OF THE INVENTION

1. Field of the Invention

The present invention generally relates to construction materials and more particularly to an improved metallic brace frame for reinforcing building walls and the like.

2. Prior Art

Various types of metallic building wall, rafter, ceiling and floor components have been used to reinforce wood structures. For example, rafters sometimes are reinforced with metallic angled plates, so also are floor and ceiling joists and the like. Occasionally, angled plates are used to rigidify wall corners and the like. Metal and wood diagonal strips have also been used to stabilize portions of wood wall frames, and in certain high rise structures all framing is done in metal.

However, little has been accomplished to reinforce conventional wooden structures against the severe stress which they typically undergo during earthquakes in the Western U.S., tornados and cyclones in the Mid-West and hurricanes in the South and East portions of the U.S.

One of the conventional means of rigidifying a wood wall frame is to apply an overlay of cellulosic material, such as sheet-rock, plywood or the like. This increases the cost of construction and in certain instances may make difficult the proper setting of electrical and plumbing lines. Moreover, the rigidifying effect of the overlay is in many cases totally inadequate for earthquake protection, as well as protection against structural damage due to high winds.

There remains a need for an improved inexpensive type of construction means for adequately, speedily and permanently reinforcing building walls and the like against the high stress encountered by buildings during earthquakes and high wind situations. Preferably, such construction means should obviate the necessity of utilizing so-called furring overlays on wood frames for increasing their rigidity.

SUMMARY OF THE INVENTION

The improved reinforcing brace frame of the present invention satisfies all the foregoing needs. The brace frame is inexpensive, simple to construct, can be made in a number of sizes and shapes and can be made adjustable to perfectly fit spaces in walls where the reinforcement is needed. The frame also removes the necessity of having to apply sheet-rock, plywood or other furring materials over a wood frame to rigidify it. Therefore, the brace frame increases the wall against stress and shear forces while speeding the overall time needed to complete a building construction.

The improved brace frame is substantially as set forth in the ABSTRACT OF THE DISCLOSURE. Thus, the brace frame is all metallic, preferably all steel, and comprises a pair of vertically spaced horizontal frame members. A pair of laterally spaced vertical frame members connected to opposite ends of the horizontal frame members to form therewith a box, and a diagonal member spanning the distance between the vertical frame members and connected to opposite ends of the horizontal frame members. The brace frame is permanently attached to wall studs, base plates and ceiling frame members, as by screws, bolts and the like. A plurality of the brace frames can be stacked directly upon each other and permanently interconnected in multi-story wall constructions. For such purposes, appropriately aligned openings in the horizontal members of the brace frames can be provided for attaching bolts, screws and the like therethrough.

Preferably, each of the horizontal frame members and the diagonal member comprise a pair of telescoping members so that the width of the brace frame can be adjusted to closely fit into a desired wall space. In such instance, the ends of the diagonal member can be received in slots in the 11 horizontal members and can be welded in place after the final placing of the brace frame.

The present invention may also include metallic vertical support members spaced between the vertical frame members and rigidly connected to the horizontal frame members. In such instances, the support members may include slots through which the diagonal member passes. In the final installation of the brace frame the diagonal member can be welded to the support members at the slots. In the event the diagonal member and the horizontal members telescope, the slots are sufficiently long to accommodate changes in angle of the diagonal member during the telescoping. Preferably, the vertical frame members also telescope so as to adjust to walls of different heighths. As a final step, all telescoping and pivoting members of the brace frame can be welded or otherwise rigidly secured against further movement so as to increase the stress and shear resistance of the brace frame.

Shims, preferably of metal, can be attached to the exterior of the frame members to assure a tight fit between the brace frame and the wood frame members of the wall. The frame members of the metallic brace frame can define a plurality of spaced openings through which nails, screws, bolts and the like can be placed to rigidly connect the brace frame to the wall.

Once the brace frame is secured in place in the wall and is itself rigidified, it greatly increases the strength of the wall, even though the brace frame itself may be relatively light. A plurality of the brace frames can be incorporated into the wall or other building area during construction of the building so as to maximize the stress resistance of the building.

Further features of the improved brace frame of the present invention are set forth in the following detailed description and accompanying drawings.

DRAWINGS

Figure 2:
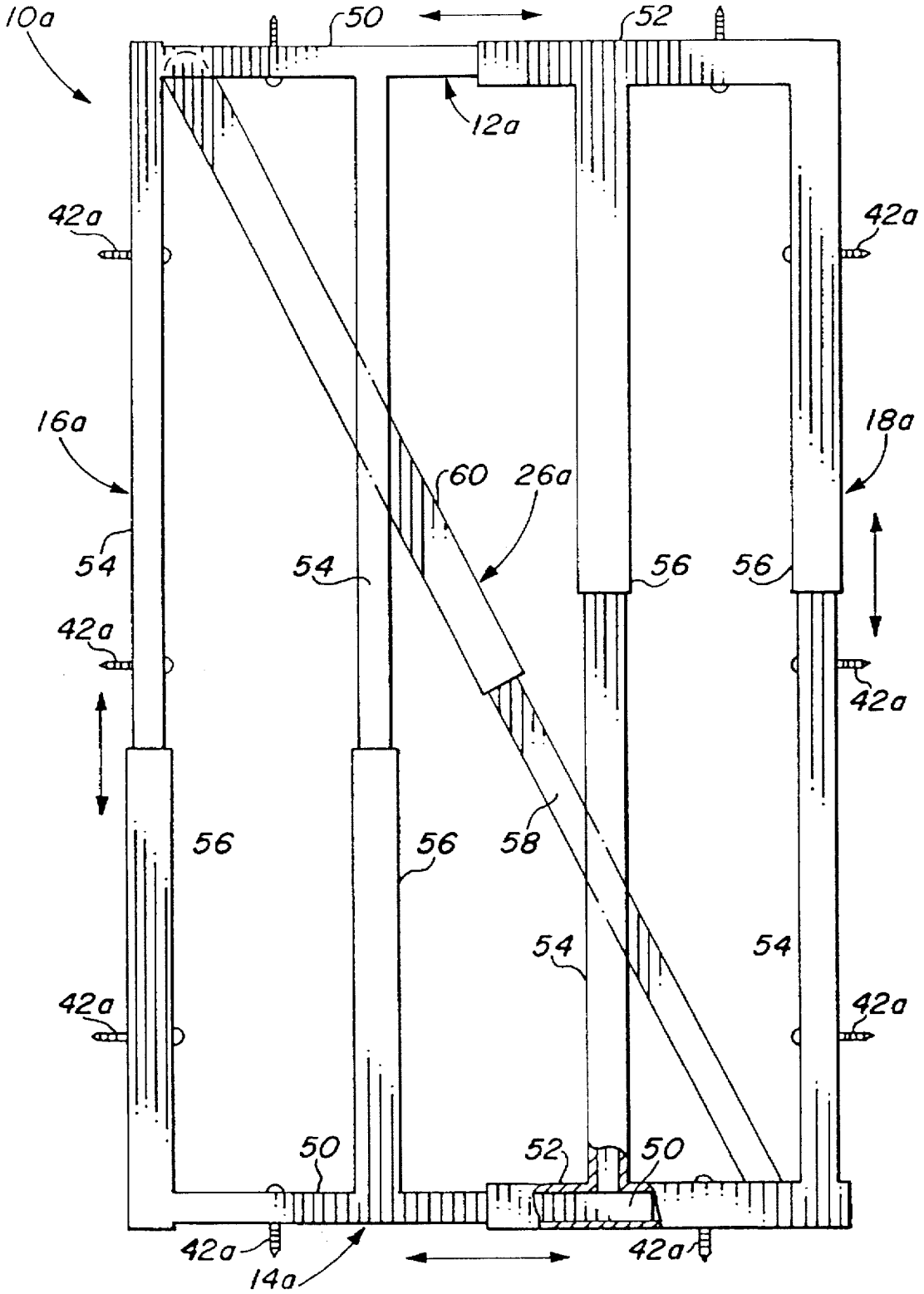
FIG. 2 is a schematic side elevation, partly broken away, of a second preferred embodiment of the improved brace frame of the present invention, shown with the brace frame in narrow untelescoped position.
Figure 3:
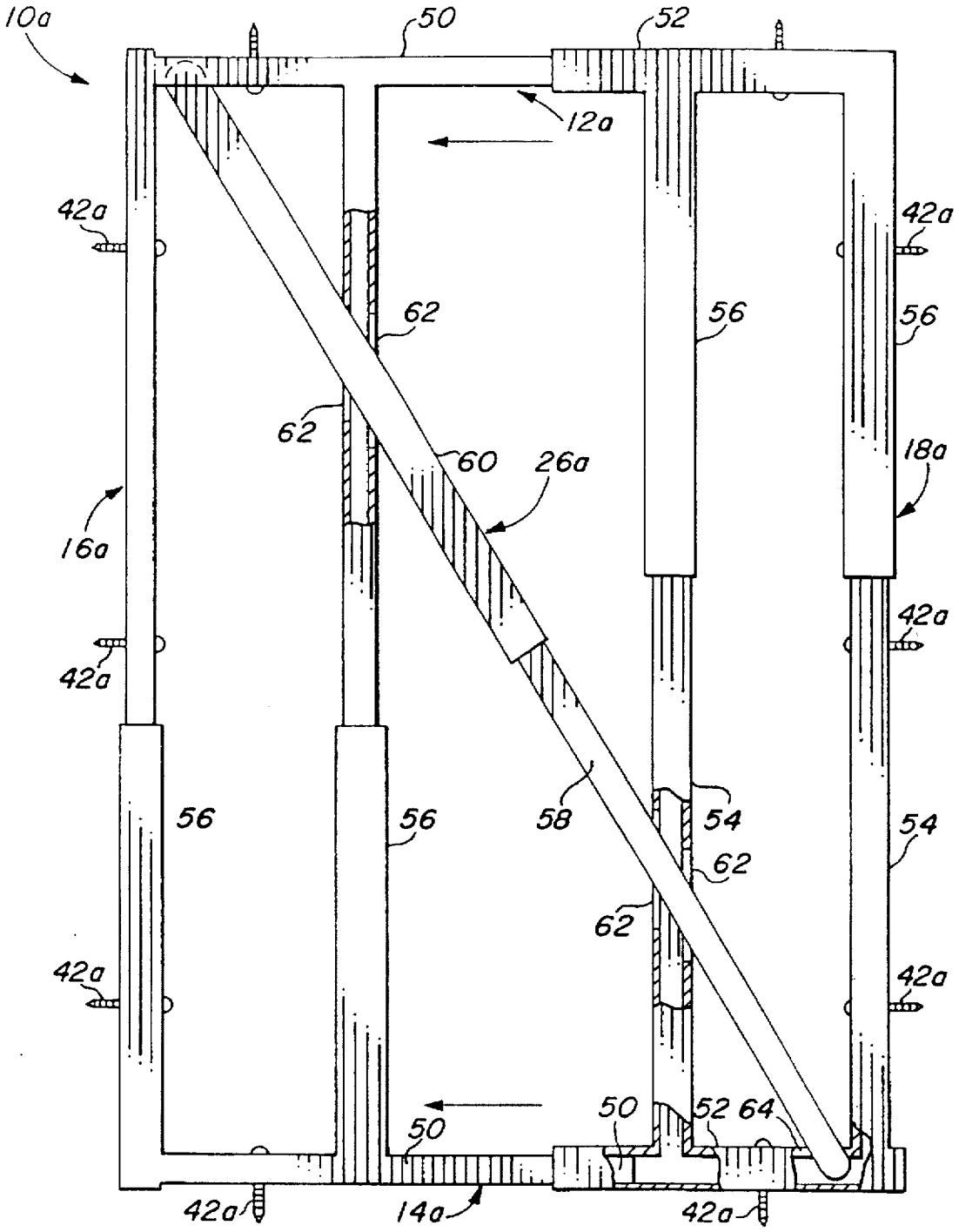
FIG. 3 is a schematic side elevation, partly broken away, of the brace frame of FIG. 2, shown in the wide telescoped position.
Figures 4, 5, 6, 7, 8:
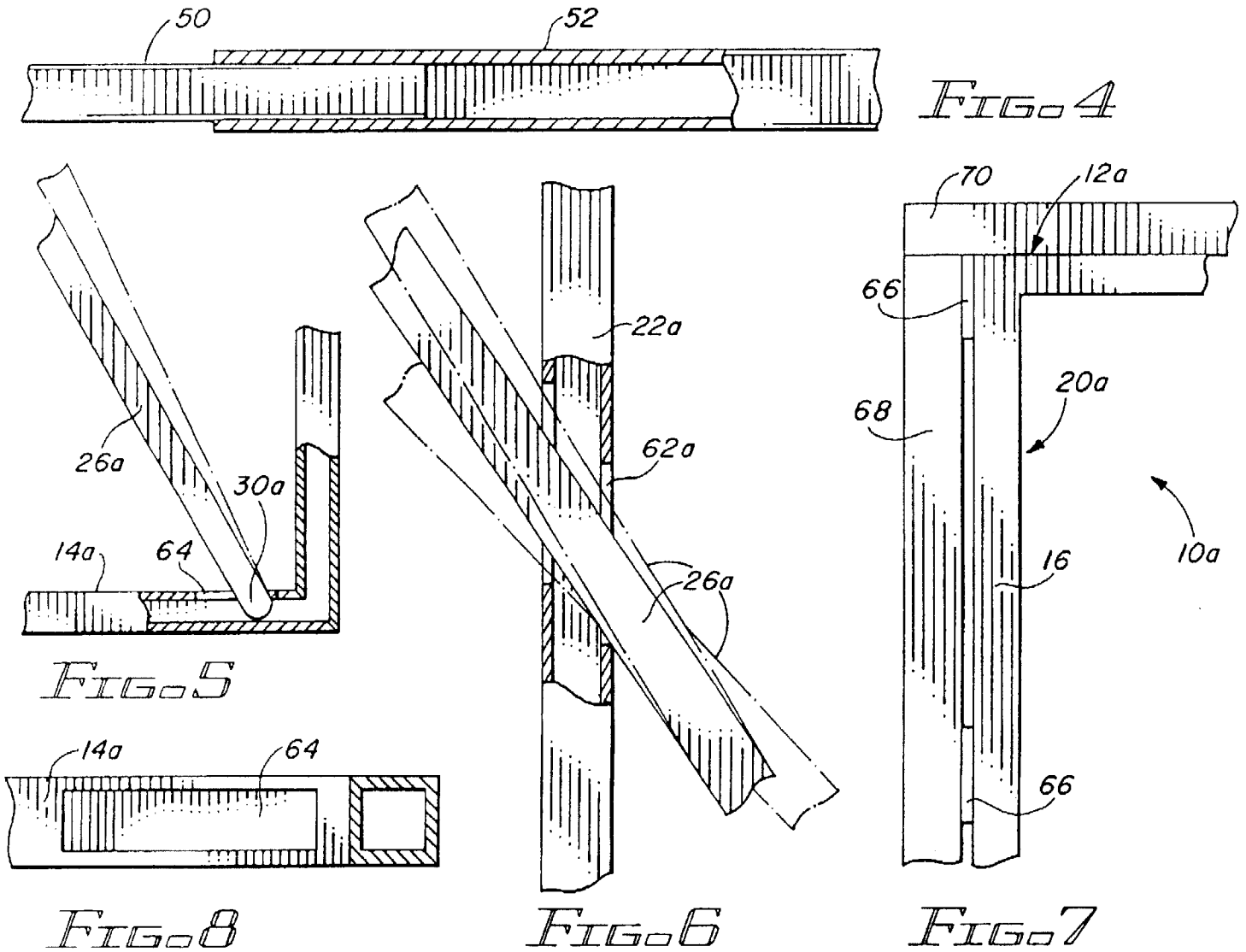
FIG. 4 is an enlarged schematic fragmentary side elevation, partly in cross-section, of a portion of the telescoped horizontal frame member of FIG. 2, showing the two components of the telescoped member.
FIG. 5 is an enlarged schematic fragmentary side elevation, partly broken away, of an end of the diagonal member and its manner of connection with a horizontal frame member.
FIG. 6 is an enlarged schematic fragmentary side elevation, partly broken away, showing the diagonal member of FIG. 2 passing through a vertical support member of FIG. 2, with the passageway or slot of sufficient diameter to permit pivoting of the diagonal member in the slot.

FIG. 7 is an enlarged fragmentary schematic side elevation, showing metal shims secured in place on the exterior of a vertical frame member of the brace frame of FIG. 2 and with the brace frame abutting a wood frame top plate and stud; and, FIG. 8 is an enlarged schematic fragmentary top plan view of a portion of a horizontal frame member of the brace frame of FIG. 2, showing a slot in the frame member through which the end of the diagonal member is received, as in FIG. 5.

DETAILED DESCRIPTION

Figure 1:
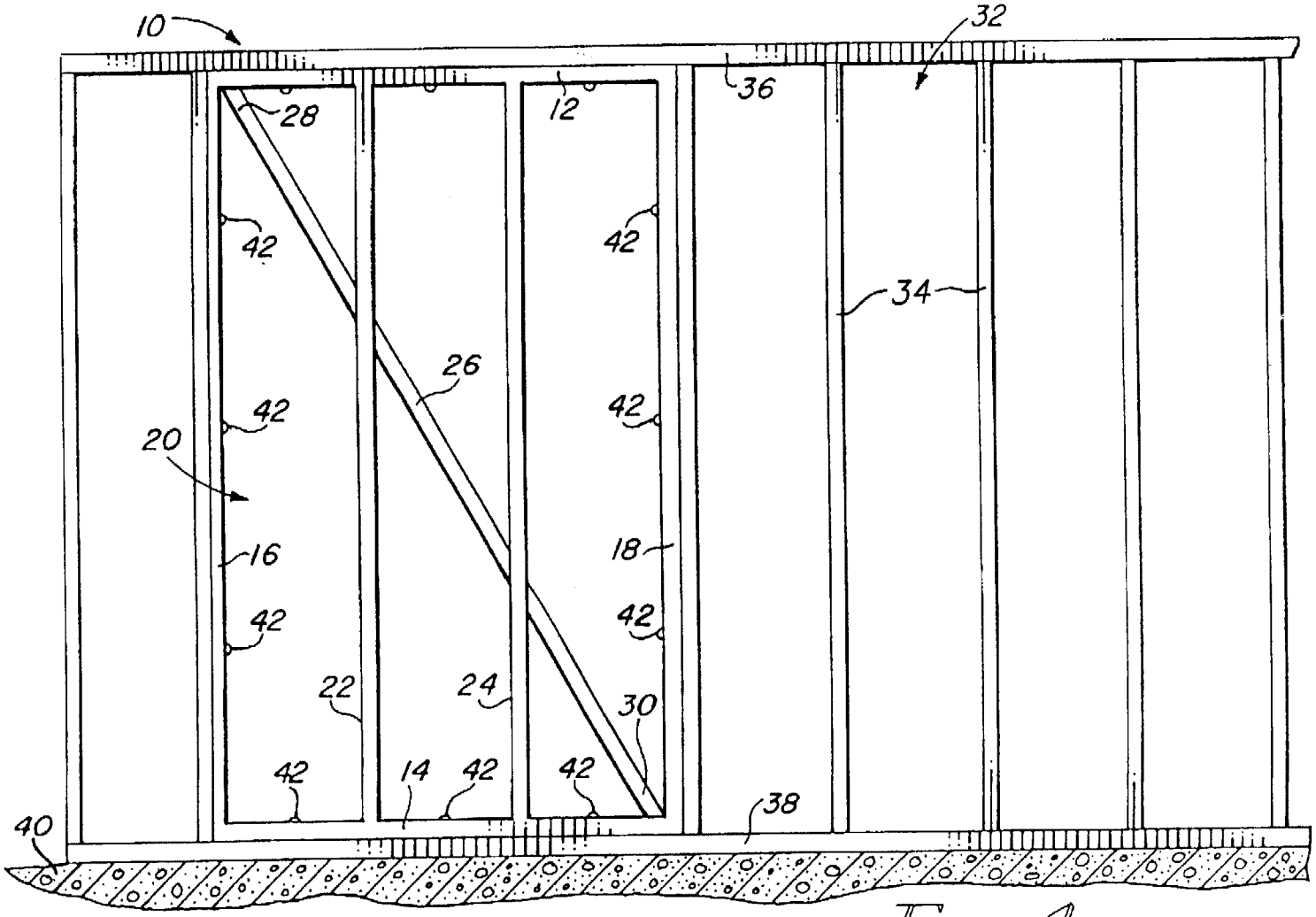
FIG. 1 is a schematic side elevation of a first preferred embodiment of the improved brace frame of the present invention, shown secured in a building wall to studs, top and bottom plates.

FIG. 1:

Now referring more particularly to FIG. 1 of the accompanying drawings, a first preferred embodiment of the all-metal brace frame of the present invention is schematically depicted therein.

Thus, brace frame 10 is shown which comprises, in combination, a vertically spaced pair of horizontal frame members 12 and 14, to the opposite ends of which are permanently connected, as by welding, brazing, bolting or the like, a laterally spaced pair of vertical frame members 16 and 18 to form therewith an open rectangular box 20. In box 20 are laterally spaced vertical support members or studs 22 and 24, permanently secured, as by welding, brazing, bolting or the like, to the upper and lower horizontal frame members 12 and 14.

Brace frame 10 also includes at least one diagonal support member 26, the opposite ends 28 and 30 of which are permanently secured, as by welding, brazing, bolting or the like, to opposite ends of the upper and lower horizontal frame members 12 and 14. The intermediate portions of diagonal support member 26 are permanently secured in like manner to the portions of vertical support members 22 and 24 which they intersect. Preferably, diagonal support members 26 passes through slots (not shown) in support members 22 and 24 and are anchored thereto at said slots.

Thus, brace frame 10 forms a self-contained strong, rigid, all-metal (preferably steel) stress-supporting unit which can be directly incorporated into the framing of a building wall during its construction to substantially increase the resistance of the wall to collapse during hurricanes, tornados and cyclones. Brace frame 10 is sufficeintly strong to obviate the use of rigidifying sheet rock and other furring material thereover, thus saving time and money during constructions.

FIG. 1 shows brace frame 10 secured in place in the wood framing of a wall 32 comprising vertical wood studs 34, wood top plate 36 and wood base plate 38 anchored to a cement floor 40. Any suitable means for anchoring brace frame 10 in place in wall 32 can be used, such as bolts or screws 42. Such anchoring means can also extend down through base plate 38 and into cememnt floor 40.

If desired, a plurality of brace frames 10 (not shown) can be stacked directly on one another, absent top plate 36, and can be welded, bolted or otherwise permanently connected together in the fabrication of a multi-story building. For such purposes, holes (not shown) in the horizontal members 12 and 14 can be aligned for bolting through two vertically stacked brace frames 10. In such instance, it is desirable to invert the upper one of the pair of stacked brace frames 10 so that the diagonal support member 26 thereof will run in the opposite direction from that of the lower brace frame 10 for additional overall wall strength.

Brace frame 10 can be made in a variety of sizes and shapes and can be pre-fabricated in finished form for use in standard wall frame openings. Brace frame 10 is inexpensive, durable and efficient in increasing the strength of wall 32 and its resistance to collapse in earthquakes and other stressful situations.

FIGS. 2–8:

A second preferred embodiment of the improved brace frame of the present invention is schematically depicted in FIGS. 2–8. Thus, brace frame **10*a* is shown. Components thereof similar to those of brace frame 10** bear the same numerals but are succeeded by the letter "a".

Brace frame **10*a* is substantially similar to brace frame 10**, differing only as follows:

a) Each of horizontal frame members **12*a* and 14*a*, vertical frame members 16*a* and 18*a* and diagonal support member 26*a* telescopes. Thus, each of horizontal frame members 12 and 14*a* comprises a narrow elongated rod 50 which telescopes within a tube 52. Each of vertical frame members 16*a* an 18*a* comprises a narrow elongated rod 54 which telescopes within a tube 56. Diagonal support member 26*a* comprises a narrow elongated rod 58 telescoping within a tube 60. Thus, brace frame 10*a* comprising box 20*a*** which can be extended and contracted horizontally and vertically so that it almost exactly fits a required space in a wood framed wall (not shown).

b) As diagonal support member **26*a* elongates and contracts during elongation and contraction of members 12*a*, 14*a*, 16*a* and 18*a*, the angle at which it passes through slots 62 in vertical support members 22*a* and 24*a* changes, as indicated by the dotted outline in FIG. 6, thus requiring slots 62 to be sufficiently elongated to permit pivoting of diagonal member 26*a*** therein.

c) The opposite ends **28*a* and 30*a* of diagonal support member 26*a* also shift their angle of interception with horizontal frame members 12*a* and 14*a* as box 20*a* is made to expand and contract, thus requiring ends 28*a* and 30*a* to rotate in slots 64 in members 12*a* and 14*a*, as shown in FIGS. 5 and 8. Once the final size of box 20*a* is determined as it is fitted into a wood frame wall ends 28*a* and 30*a* are then welded, bolted or brazed into a fixed position in slots 64**.

d) Shims 66 (FIG. 7) in the form of flat or wedge-shaped plates of metal are secured to the outer surfaces of box **20*a*, as by bolting, screwing, welding, brazing or the like in order to assure a tight correct fit of brace frame 10*a* with the adjoining wood framing, such as the stud 68 and top plate 70 shown in FIG. 7. Alternatively, shims 66 can merely be driven into place to fill gaps between box 20*a*** and the wood framing.

Brace frame **10*a* has the other advantages of brace frame 10**.

Various modifications, changes, alterations and additions can be made in the improved structural brace frame of the present invention, its components and their parameters. All such modifications, changes, alterations and additions as are within the scope of the appended claims form part of the present invention.

What is claimed is:

1. An improved reinforcing brace frame which serves as a shear wall in framed structures and which is adapted to be inserted within the area of a stud wall formed by the vertically extending studs and the horizontally extending sills and top plates, said frame comprising:

a) a lower metallic horizontally extending frame member;

b) an upper metallic horizontally extending frame member;

c) a first pair of metallic vertically extending spaced frame members rigidly connected at opposite ends to said upper and lower horizontally extending frame members to form a rigid upright building frame;

d) a second pair of metallic vertically extending spaced frame members rigidly connected at opposite ends to said upper and lower horizontally extending frame members in between said first pair of metallic vertically extending spaced frame members;

e) a metallic diagonal member whose ends are rigidly connected to opposite ends of said lower and upper horizontally extending frame members and whose mid-section is rigidly connected to said second pair of vertically extending spaced frame members;

f) a pair of slots in said lower horizontally extending member to provide a means for attaching said lower horizontally extending member to a concrete foundation; and a pair of slots in said upper horizontally extending member to provide a means for attaching said upper horizontally extending member to said horizontally extending upper sills wherein said reinforcing brace frame provides a system for withstanding shear wall stress.

2. An improved reinforcing brace frame as in claim 1 wherein said means for attaching said frame to said horizontally extending upper sills is selected from the group consisting of bolts and screws.

3. An improved reinforcing brace frame as in claim 1 wherein said means for attaching said frame to said concrete foundation is selected from the group consisting of bolts and screws.

* * * * *